US009988966B2

(12) United States Patent
Lee et al.

(10) Patent No.: US 9,988,966 B2
(45) Date of Patent: Jun. 5, 2018

(54) ENGINE SYSTEM HAVING COOLANT CONTROL VALVE

(71) Applicant: HYUNDAI MOTOR COMPANY, Seoul (KR)

(72) Inventors: Hyo Jo Lee, Suwon-si (KR); Tae Man Chung, Yongin-si (KR); Sang Phil Han, Suwon-si (KR); Woo Yeol Jung, Hwaseong-si (KR); Yonggyu Lee, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days. days.

(21) Appl. No.: 15/257,132

(22) Filed: Sep. 6, 2016

(65) Prior Publication Data

US 2017/0138248 A1 May 18, 2017

(30) Foreign Application Priority Data

Nov. 18, 2015 (KR) ..... 10-2015-0161802

(51) Int. Cl.
*F01P 7/16* (2006.01)
*F01P 3/02* (2006.01)
(Continued)

(52) U.S. Cl.
CPC ..... *F01P 7/16* (2013.01); *F01P 3/02* (2013.01); *F01P 11/08* (2013.01); *F01P 2003/027* (2013.01); *F01P 2007/146* (2013.01)

(58) Field of Classification Search
CPC .. F01P 2007/146; F01P 2003/027; F01P 3/02; F01P 2003/028; F01P 1/02;
(Continued)

(56) References Cited

U.S. PATENT DOCUMENTS 7,334,545 B2 * 2/2008 Muller ..... F01P 3/02 123/41.08
8,757,110 B2 * 6/2014 Triebe ..... F01P 7/14 123/41.1
(Continued)

FOREIGN PATENT DOCUMENTS

JP 2009-537732 A 10/2009
JP 2013-024126 A 2/2013
(Continued)

*Primary Examiner* — Long T Tran
(74) *Attorney, Agent, or Firm* — Brinks Gilson & Lione

(57) ABSTRACT

An engine system with a coolant control valve includes: a valve housing having a first valve space and a second valve space formed at both sides by a partition and including a connection passage formed in the partition; a first rotary valve disposed in the first valve space and having first coolant passages; a second rotary valve disposed in the second valve space and having second coolant passages; distribution lines respectively connected to positions corresponding to the first coolant passages and the second coolant passages and distributing the coolant coming through the first rotary valve and the second rotary valve; and a driver to rotate the first rotary valve and the second rotary valve. In particular, the first and second coolant passages are connected to the connection passage depending on the rotation positions of the first rotary valve and the second rotary valve.

12 Claims, 7 Drawing Sheets

(51) Int. Cl.
*F01P 11/08* (2006.01)
*F01P 7/14* (2006.01)

(58) Field of Classification Search
CPC ... F01L 7/02; F01L 7/021; F01L 7/024; F01L 7/027
See application file for complete search history.

(56) References Cited

U.S. PATENT DOCUMENTS

| | | | | |
|---|---|---|---|---|
| 8,881,693 | B2 * | 11/2014 | Hayashi | F01P 7/167 123/41.01 |
| 2012/0048217 | A1 * | 3/2012 | Triebe | F01P 7/14 123/41.1 |
| 2014/0026829 | A1 * | 1/2014 | Tobergte | F01P 3/02 123/41.1 |
| 2014/0069522 | A1 * | 3/2014 | Kuze | F01P 7/14 137/334 |
| 2015/0027575 | A1 * | 1/2015 | Morein | F01P 7/14 137/865 |
| 2015/0107691 | A1 * | 4/2015 | Lallemant | F02B 29/0418 137/340 |
| 2015/0136259 | A1 * | 5/2015 | Lallemant | F02B 29/0418 137/625.46 |
| 2015/0176470 | A1 * | 6/2015 | Lee | F01P 7/14 123/41.29 |

FOREIGN PATENT DOCUMENTS

| | | | |
|---|---|---|---|
| JP | 2013-130166 | A | 7/2013 |
| JP | 2013-177843 | A | 9/2013 |

* cited by examiner

ENGINE SYSTEM HAVING COOLANT CONTROL VALVE

CROSS-REFERENCE TO RELATED APPLICATION

This application claims priority to and the benefit of Korean Patent Application No. 10-2015-0161802, filed on Nov. 18, 2015, the entire contents of which are incorporated herein by reference.

FIELD

The present disclosure relates to an engine system having a coolant control valve to improve an entire cooling efficiency and a fuel consumption.

BACKGROUND

The statements in this section merely provide background information related to the present disclosure and may not constitute prior art.

Engines produce torque by burning a fuel to create engine, and discharge surplus thermal energy. Particularly, a coolant absorbs thermal energy as it circulates through an engine, a heater, and a radiator, and releases the thermal energy.

Oil becomes highly viscous at low engine coolant temperatures. With thick oil, friction and fuel consumption increase, and exhaust gas temperatures rise gradually, lengthening the time taken for catalyst activation and causing deterioration in exhaust gas quality. Moreover, it takes a long time to get a heater to function normally, so passengers and a driver will feel cold.

When the engine coolant temperature is excessively high, knocking may occur. If ignition timing is adjusted to suppress knocking, the engine performance may be degraded. In addition, excessive lubricant temperatures may result in poor lubrication.

However, one coolant control valve is used in specific regions of an engine, and is a valve that controls a number of cooling elements, like keeping the coolant at high temperatures and other regions at low temperatures.

On the other hand, the coolant of the cylinder block of the relatively low temperature is supplied to the oil cooler and the EGR cooler in a warm condition of the temperature of the coolant such that the fuel consumption may be increased due to the decreasing of the oil temperature and the temperature of the EGR cooler may be overcooled, or the coolant of the cylinder head of the relatively high temperature is supplied to the oil cooler and the EGR cooler such that the oil temperature may be overheated and the temperature of the EGR cooler may be overheated in a high temperature condition of the coolant.

The above information disclosed in this Background section is only for enhancement of understanding of the background of the present disclosure and therefore it may contain information that does not form the prior art that is already known in this country to a person of ordinary skill in the art.

SUMMARY

The present disclosure provides an engine system with a coolant control valve supplying the coolant having a desired temperature to the oil cooler and a EGR cooler depending the temperature of the coolant to improve the fuel consumption efficiency and to cool effectively an recirculation exhaust gas.

An engine system with a coolant control valve according to one form of the present disclosure includes: a valve housing having a first valve space and a second valve space formed at both sides via a partition and including a connection passage formed in the partition; a first rotary valve disposed in the first valve space and having first coolant passages formed at a predetermined position from an interior circumference to an exterior circumference thereof, wherein one of the first coolant passages is formed at the position corresponding to the connection passage; a second rotary valve disposed in the second valve space and having second coolant passages formed at a predetermined position from an interior circumference to an exterior circumference thereof, wherein one of the second coolant passage is formed at a position corresponding to the connection passage; distribution lines respectively connected to positions corresponding to the first coolant passages and the second coolant passages that do not correspond to the connection passage in the valve housing and distributed with the coolant passing through the first rotary valve and the second rotary valve; and a driver disposed to rotate the first rotary valve and the second rotary valve, wherein the first and second coolant passages corresponding to the connection passage are connected to each other depending on the rotation positions of the first rotary valve and the second rotary valve.

The coolant exhausted from the cylinder head may be supplied to the center of the first rotary valve, and the coolant exhausted from the cylinder block may be supplied to the center of the second rotary valve.

The distribution lines may include a first distribution line connected to a heater core disposed to heat an inner air; a second distribution line connected to a radiator disposed to discharge the heat of the coolant; a third distribution line connected to an oil cooler disposed to heat or cool the oil circulating the engine; and a fourth distribution line connected to an EGR cooler disposed to cool the exhaust gas recirculating from the exhaust line to the intake line.

The driver may include a motor; a drive gear rotated by the motor; a first driven gear externally meshed with the drive gear and disposed to be together rotated with the first rotary valve; and a second driven gear externally meshed with the first driven gear and disposed to be together rotated with the second rotary valve.

A control portion controlling the driver depending on the temperature of the coolant may be further included.

The control portion may control the rotation positions of the first rotary valve and the second rotary valve such that the coolant is not flowed to the first, second, third, and fourth distribution lines in a cooling state that the temperature of the coolant is lower than a first predetermined temperature.

The control portion may control the rotation positions of the first rotary valve and the second rotary valve such that the coolant flows to the first distribution line and the coolant is not flowed to the second, third, and fourth distribution lines in a low temperature state that the temperature of the coolant is higher than the first predetermined temperature and is lower than a second predetermined temperature.

The control portion may control the rotation positions of the first rotary valve and the second rotary valve such that the coolant flows to the first, third, and fourth distribution lines and the coolant is not flowed to the second distribution line and the first and second rotary valves open the connection passage in a warm state that the temperature of the coolant is higher than the second predetermined temperature and is lower than a third predetermined temperature.

The control portion may control the rotation positions of the first rotary valve and the second rotary valve such that the coolant flows to the first, second, third, and fourth distribution lines and the first and second rotary valves close the connection passage in a hot state that the temperature of the coolant is higher than the third predetermined temperature.

An engine system with a coolant control valve according to another form of the present disclosure includes: a valve housing having a first valve space and a second valve space formed at both sides via a partition and including a connection passage formed in the partition; a first rotary valve disposed in the first valve space and having first coolant passages formed at a predetermined position from an interior circumference to an exterior circumference thereof, wherein one of the first coolant passages is formed at the position corresponding to the connection passage; a second rotary valve disposed in the second valve space and having second coolant passages formed at a predetermined position from an interior circumference to an exterior circumference thereof, wherein one of the second coolant passage is formed at the position corresponding to the connection passage; distribution lines respectively connected to the positions corresponding to the first coolant passages and the second coolant passages that do not correspond to the connection passage in the valve housing and distributed with the coolant passing through the first rotary valve and the second rotary valve; and a control portion disposed to rotate the first rotary valve and the second rotary valve through the driver and selectively connecting the first and second coolant passages corresponding to the connection passage to each other.

The control portion may control the rotation positions of the first rotary valve and the second rotary valve in the warm state that the temperature of the coolant is higher than a second predetermined temperature and is lower than a third predetermined temperature such that the first and second rotary valves open the connection passage, the coolant is supplied to the heater core through one among the first coolant passages of the first rotary valve, and the coolant is supplied to the oil cooler and the EGR cooler through the second coolant passages of the second rotary valve.

The control portion may control the rotation positions of the first rotary valve and the second rotary valve in the hot state that the temperature of the coolant is higher than a third predetermined temperature such that the first and second rotary valves close the connection passage, the coolant is supplied to the heater core and the radiator through the first coolant passages of the first rotary valve, and the coolant is supplied to the oil cooler and the EGR cooler through the second coolant passages of the second rotary valve.

According to the present disclosure, the coolant control valve is divided into the first and second valve spaces corresponding to the cylinder head and the cylinder block and selectively connects them depending on an operation condition such that the efficiency of the cooling system may be improved.

Also, in the warm state, the first and second valve spaces are connected through the connection passage to mix the coolant to each other such that the coolant of the cylinder head of the relatively high temperature increases the temperature of the oil through the oil cooler, thereby reducing the fuel consumption and adjusting the temperature of the EGR cooler.

Particularly, in the hot state, the first and second valve spaces are closed to each other such that the coolant exhaust from the cylinder head and the cylinder block is mixed to each other, thereby effectively cooling the oil cooler and the EGR cooler by using the coolant of the cylinder block in which the temperature of the coolant is relatively low.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
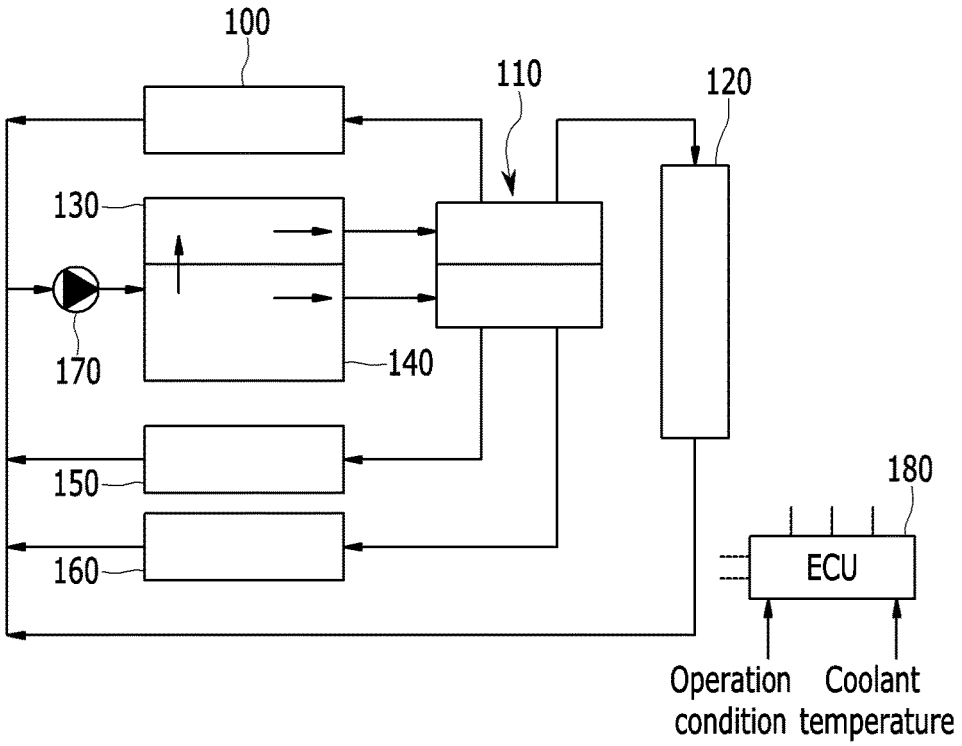
FIG. 1 is a flowchart showing an entire flow of a coolant in an engine system with a coolant control valve.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 is a flowchart showing an entire flow of a coolant in an engine system with a coolant control valve according to one form of the present disclosure.

Referring to FIG. 1, an engine system includes: a heater core 100, a coolant control valve 110, a radiator 120, a cylinder head 130, a cylinder block 140, an oil cooler 150, an EGR cooler 160, a coolant pump 170, and a control portion 180.

The heater core 100 is disposed to warm an indoor air of a vehicle by using a supplied warm coolant, and the oil cooler 150 is disposed to execute a function of cooling an oil circulating in an engine or a transmission by using the supplied coolant.

The EGR cooler 160 executes a function of cooling a recycled exhaust gas by using the supplied coolant, and the radiator 120 executes a function of discharging the heat of the supplied coolant.

The cylinder head 130 is disposed on the cylinder block 140, the coolant pump 170 pumps the coolant to one side of the cylinder block 140, the part of the coolant supplied to the cylinder block 140 is supplied to one side lower part of the cylinder head 130, and the rest passes through the cylinder block 140.

Also, a structure that the coolant exhausted from the cylinder head 130 and the coolant exhausted from the cylinder block 140 may be supplied to the coolant control valve 110 is provided.

The coolant control valve 110 is set to distribute the coolant supplied from the cylinder head 130 to the heater core 100 and the radiator 120 and distribute the coolant supplied from the cylinder block 140 to the oil cooler 150 and the EGR cooler 160.

Also, the coolant supplied from the cylinder head 130 and the cylinder block 140 may be mixed to each other depending a driving condition.

In one form, the control portion 180 controls the coolant control valve 110 depending on the operation condition of the engine or the temperature of the coolant, thereby effectively and rapidly controls the entire coolant system.

Figure 2:
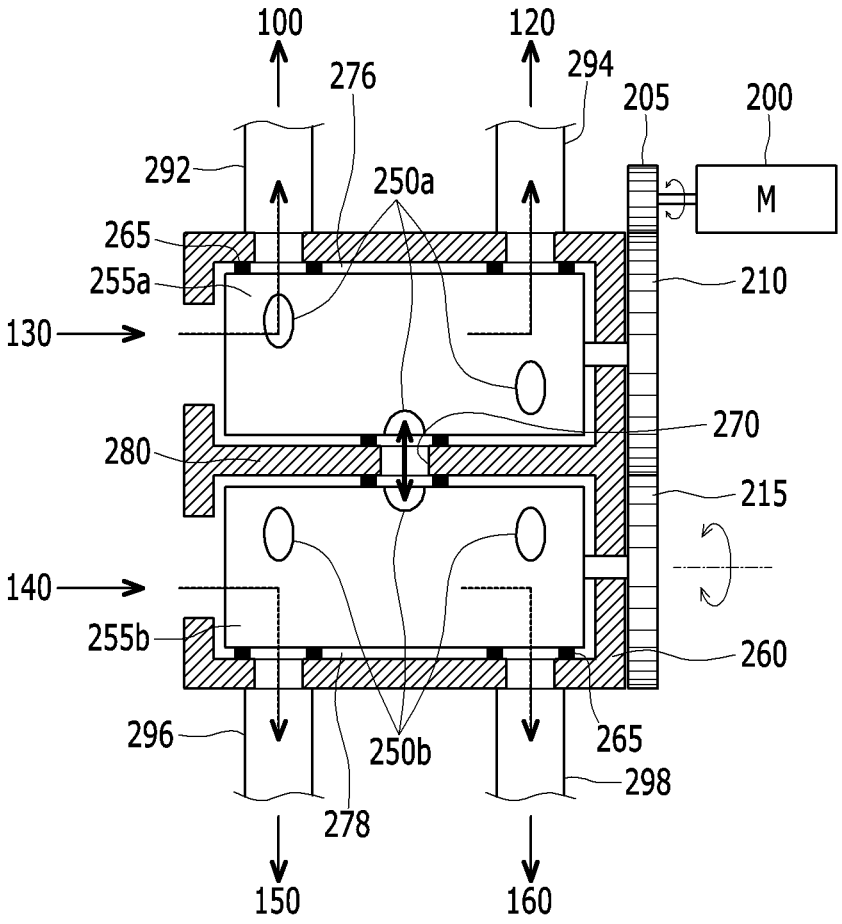
FIG. 2 is a schematic cross-sectional view of a length direction of a coolant control valve.
Figure 3:
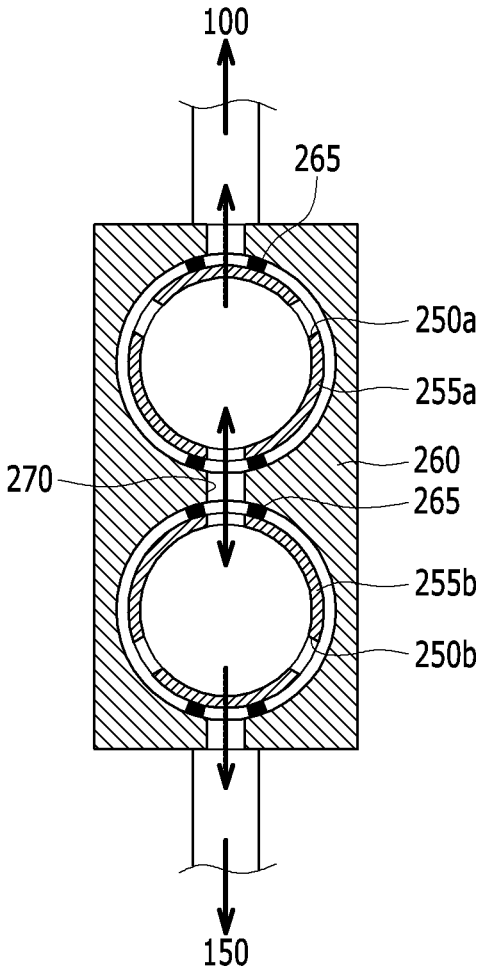
FIG. 3 is a schematic cross-sectional view of a width direction of a coolant control valve.

FIG. 2 is a schematic cross-sectional view of a length direction of a coolant control valve according to one form of the present disclosure, and FIG. 3 is a schematic cross-sectional view of a width direction of a coolant control valve according to one form of the present disclosure.

Referring to FIG. 2 and FIG. 3, the coolant control valve 110 includes: a first rotary valve 255*a*, a sealing member 265, a first coolant passage 250*a*, a first valve space 276, a drive gear 205, a motor 200, a first driven gear 210, a connection passage 270, a second driven gear 215, a valve housing 260, a second coolant passage 250*b*, a second valve space 278, a second rotary valve 255*b*, and a partition 280. Also, at a predetermined position outside of the valve housing 260, a first distribution line 292, a second distribution line 294, a third distribution line 296, and a fourth distribution line 298 are connected, respectively.

The first valve space 276 is formed at the position corresponding to the cylinder head 130 in the upper side of the valve housing 260 and the second valve space 278 is formed at the position corresponding to the cylinder block 140 in the lower side.

The partition 280 is formed between the first valve space 276 and the second valve space 278, and the connection passage 270 connecting the first valve space 276 and the second valve space 278 to each other is formed in the partition 280.

In the first valve space 276, the first rotary valve 255*a* of a pipe shape is disposed, and an interior circumference of the first valve space 276 and an exterior circumference of the first rotary valve 255*a* has a shape corresponding to each other.

In the first rotary valve 255*a*, three first coolant passages 250*a* are formed at a predetermined position from the interior circumference to the exterior circumference. In one form, the first coolant passage 250*a* is three, however it may be changed depending on a design specification. The center of the first coolant passages 250*a* is formed at the position corresponding to the connection passage 270.

Furthermore, the first distribution line 292 and the second distribution line 294 are connected by the valve housing 260 with a predetermined interval. The first and second distribution lines 292, 294 are disposed in the upper side of the valve housing 260, and in the first rotary valve 255*a*, the first coolant passage(s) 250*a* are respectively formed at the positions corresponding to the first and second distribution lines 292 and 294.

Accordingly, as the first rotary valve 255*a* is rotated, the first coolant passage(s) 250*a* may be communicated with the first distribution line and/or the second distribution line. According to one form, the coolant may be transferred via the first coolant passage(s) 250*a*. The coolant profile may be formed inside of the first rotary valve 255*a* and communicated with the first and second distribution lines 292, 294 when the first rotary valve 255*a* is rotated. The position of coolant profile may be changed.

Also, the sealing member 265 is interposed between the interior circumference of the first valve space 276 of the valve housing 260 and the exterior circumference of the first rotary valve 255*a*. The sealing member 265 may inhibit or prevent the coolant distributed to the first distribution line 292 through the first coolant passage(s) 250*a* and the coolant distributed to the second distribution line 294 through the first coolant passage(s) from being leaved through the sealing structure.

In one form of the present disclosure, the coolant exhausted from the cylinder head 130 is supplied to the center of the first rotary valve 255*a* through the upper part of one side of the valve housing 260, and the supplied coolant is respectively distributed to the first distribution line 292 or the second distribution line 294 through the first coolant passage(s) 250*a*. Here, the first distribution line 292 is connected to the heater core 100, and the second distribution line 294 is connected to the radiator 120.

In the second valve space 278, the second rotary valve 255*b* in a pipe shape is disposed, and the interior circumference of the second valve space 278 and the exterior circumference of the second rotary valve 255*b* have the shape corresponding to each other.

In the second rotary valve 255*b*, three second coolant passages 250*b* are formed at a predetermined position from the interior circumference to the exterior circumference. The three second coolant passages 250*b* are shown in FIG. 2, and the number of the second passages may be changed depending on a design specification. The center of the second coolant passages 250*b* is formed at a position corresponding to the connection passage 270.

Furthermore, the third distribution line 296 and the fourth distribution line 298 are connected by the valve housing 260 with a predetermined interval on the lower side of the valve housing 260, and the second coolant passage 250*b*(s) are respectively formed at positions corresponding to the third and fourth distribution lines 296 and 298 in the second rotary valve 255*b*.

Accordingly, as the second rotary valve 225*b* is rotated, the second coolant passage(s) 250*b* may be communicated with the third distribution line and/or the fourth distribution line. According to one form, the coolant may be transferred via the second coolant passage(s) 250*b*, and the coolant profile may be formed inside of the second rotary valve 255*b* and communicated with the third and fourth distribution lines 296, 298 when the second rotary valve 255*b* is rotated. The position of coolant profile may be changed.

Also, the sealing member 265 is interposed between the interior circumference of the second valve space 278 of the valve housing 260 and the exterior circumference of the second rotary valve 255*b*, and the sealing member 265 may inhibit or prevent the coolant distributed to the third distribution line 296 through the second coolant passage 250*b* and the coolant distributed to the fourth distribution line 298 through the second coolant passage 250*b* from being leaving to the third distribution line 296 through the sealing structure.

In another form of the present disclosure, the coolant exhausted from the cylinder block 140 is supplied to the center of the second rotary valve 255*b* through the lower part of one side of the valve housing 260, and the supplied coolant is respectively distributed to the third distribution line 296 or the fourth distribution line 298 through the second coolant passage 250*b*. Here, the third distribution line 296 is connected to the oil cooler 150, and the fourth distribution line 298 is connected to the EGR cooler 160.

The first driven gear 210 that is rotated along with the first rotary valve 255*a* is disposed at the other side of the valve housing 260 and the second driven gear 215 that is rotated along with the second rotary valve 255*b* is disposed, and the first driven gear 210 and the second driven gear 215 are externally meshed to each other.

Meanwhile, the first driven gear 210 and the second gear 215 may have a predetermined gear ratio. In one, the number of teeth of the first driven gear 210 may be larger than the number of teeth of the second driven gear 215. The first driven gear 210 which rotates the first rotary valve 255*a* received relatively higher temperature coolant may be controlled delicately. For example, the ratio between the first driven gear 210 and the second driven gear 215 may be 1.2.

Also, the first driven gear 210 and the drive gear 205 are externally meshed, and the motor 200 is disposed to rotate the first drive gear 205.

When the control portion 180 (e.g., an engine control unit "ECU") outputs signals to rotate the motor 200, the drive gear 205 rotates the first driven gear 210 and the first rotary valve 255*a*. The first driven gear 210 rotates the second driven gear 215 and the second rotary valve 255*b*.

Accordingly, both the first and second rotary valves 255*a* and 255*b* may be simultaneously controlled through one motor 200. The connection passage 270 may be selectively connected depending on the rotation position of the first and second rotary valves 255*a* and 255*b*, and the coolant may be selectively distributed to the first, second, third, and fourth distribution lines 292, 294, 296, and 298.

FIGS. 4 to 7 are flowcharts showing a flow of a coolant depending on an operation condition in an engine system according to the present disclosure.

Figure 4:
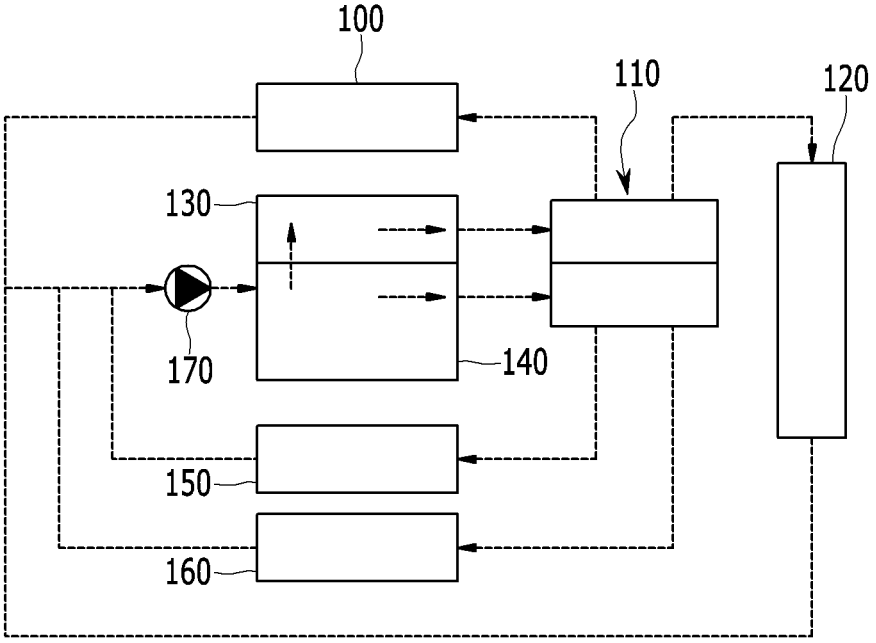
FIGS. 4 to 7 are flowcharts showing a flow of a coolant depending on an operation condition in an engine system.

Referring to FIG. 4, in a cooling state that the temperature of the coolant is lower than a first predetermined temperature, the control portion 180 controls the motor 200 to control the rotation positions of the first rotary valve 255*a* and the second rotary valve 255*b* for the coolant not to be flowed to the first, second, third, fourth distribution lines, and the connection passage 292, 294, 296, 298, and 270. Accordingly, the coolant passing through the cylinder head 130 and the cylinder block 140 is stopped or reduced, thereby shortening a warming up time of the engine.

The first predetermined temperature of coolant may be below 40 degrees.

Figure 5:
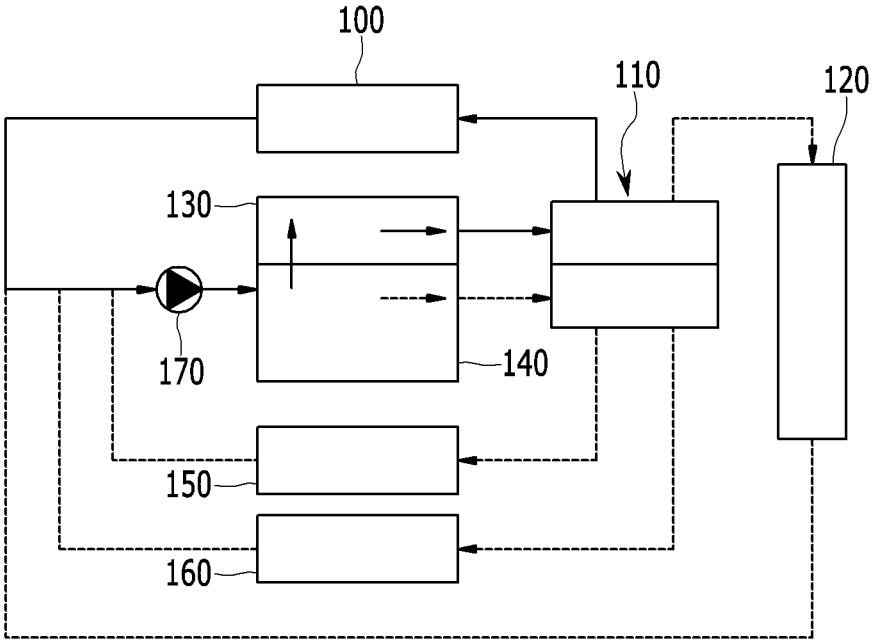

Referring to FIG. 5, in a low temperature that the temperature of the coolant is higher than first predetermined temperature and is lower than a second predetermined temperature, the control portion 180 controls the motor 200 to control the rotation positions of the first rotary valve 255*a* and the second rotary valve 255*b* such that the coolant flows to the first distribution line 292, and the coolant does not flow to the second, third, and fourth distribution lines 294, 296, and 298.

Accordingly, by using the coolant which passes through the cylinder head 130 and is relatively high temperature, the coolant may be appropriately distributed to the heater core 100, and heats the heater core 100. Here, the connection passage 270 is closed such that the coolant passing through the cylinder head 130 is supplied to the first rotary valve 255*a*. The second predetermined temperature of coolant may be 60 degrees.

Figure 6:
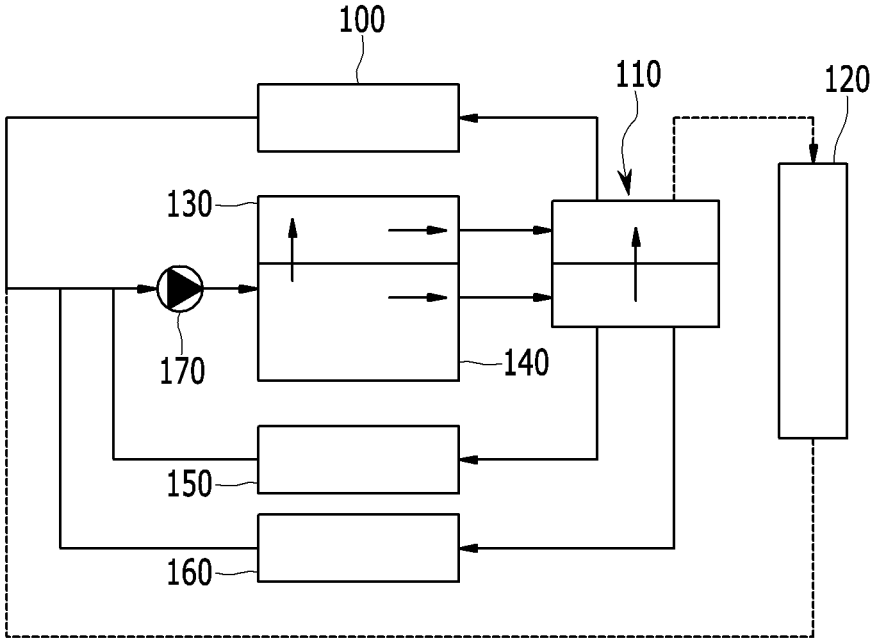

Referring to FIG. 6, in the warm state that the temperature of the coolant is higher than the second predetermined temperature and is lower than a third predetermined temperature, the control portion 180 controls the motor 200 to control the rotation positions of the first rotary valve 255*a* and the second rotary valve 255*b* such that the coolant flows to the first, third, and fourth distribution lines 292, 296, and 298 and the coolant does not flow to the second distribution line 294.

Accordingly, by using the coolant passing through the cylinder head 130 and the cylinder block 140, the coolant may be appropriately distributed to the heater core 100, the EGR cooler 160, and the oil cooler 150. In this case, the first and the second coolant passage 250*a* and 250*b* of the first rotary valve 255*a* and the second rotary valve 255*b* are communicated each other, and the connection passage 270 is opened. Therefore, the coolant passing through the cylinder head 130 and the cylinder block 140 may be respectively supplied to the first rotary valve 255*a* and the second rotary valve 255*b* and may be mixed together.

Here, the coolant that is discharged from the cylinder head 130 and has the relatively high temperature is supplied to the oil cooler 150 and the EGR cooler 160 such that the fuel consumption may be improved and the temperature of the EGR cooler 160 may be appropriately adjusted by the increasing of the temperature of the engine oil. In addition, the heater core 100 is heated by the coolant passing through the first rotary valve 255*a* of cylinder head 130 into the first distribution line 292.

The third predetermined temperature of coolant may be 90 degrees.

Figure 7:
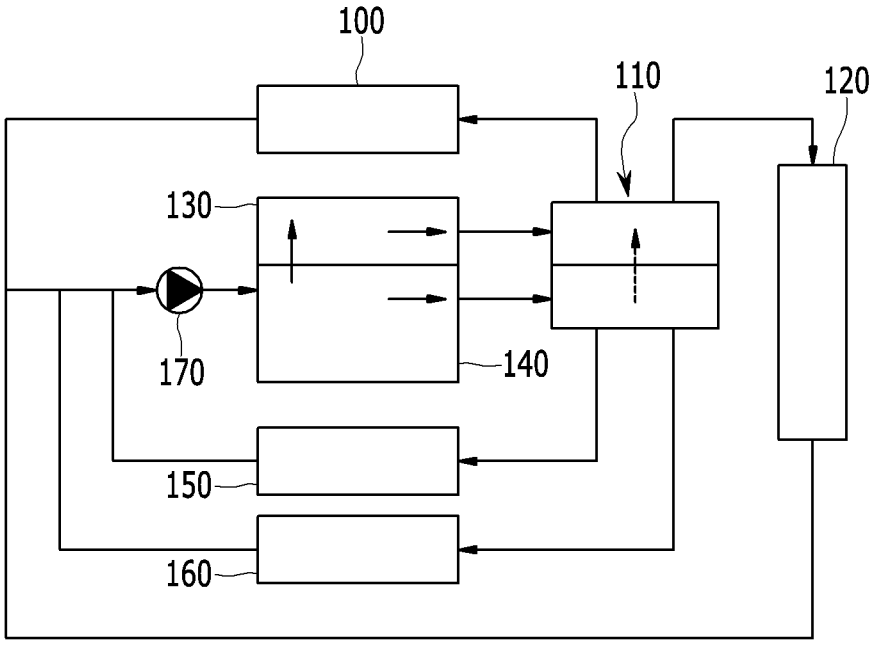

Referring to FIG. 7, in a hot state that the temperature of the coolant is higher than the third predetermined temperature, the control portion 180 controls the motor 200 to control the rotation positions of the first rotary valve 255*a* and the second rotary valve 255*b* such that the coolant flows to the first, second, third, and fourth distribution lines 292, 294, 296, and 298, thereby controlling the entire positions.

Accordingly, by using the coolant passing through the cylinder head 130 and the cylinder block 140, the coolant may be appropriately distributed to the heater core 100, the oil cooler 150, the EGR cooler 160, and the radiator 120.

In this case, the connection passage 270 between the first rotary valve 255*a* and the second rotary valve 255*b* is closed such the first and the second coolant passage 250*a* and 250*b* are not communicated each other. In other words, the coolant passing through the cylinder head 130 and the cylinder block 140 may be separately supplied to the first rotary valve 255*a* and the second rotary valve 255*b* respectively. From this structure, the coolant which is relatively high temperature passing through the cylinder head is supplied into and cooled by the radiator 120 and heats the heater core 100. And the coolant which is relatively lower temperature passing through the cylinder block 140 cools the EGR cooler 160 and the oil cooler 150.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the appended claims.

<Description of symbols>

| | |
|---|---|
| 100: heater core | 110: coolant control valve |
| 120: radiator | 130: cylinder head |
| 140: cylinder block | 150: oil cooler |
| 160: EGR cooler | 170: coolant pump |
| 180: control portion | 200: motor |
| 205: drive gear | 210: first driven gear |
| 215: second driven gear | 250a: first coolant passage |
| 250b: second coolant passage | 255a: first rotary valve |
| 255b: second rotary valve | 260: valve housing |
| 265: sealing member | 270: connection passage |
| 276: first valve space | 278: second valve space |
| 280: partition | 292: first distribution line |
| 294: second distribution line | 296: third distribution line |
| 298: fourth distribution line | |

What is claimed is:

1. An engine system having a coolant control valve, comprising:

a valve housing having a partition, the partition defining a first valve space and a second valve space of the valve housing;

a connection passage formed in the partition;

a first rotary valve disposed in the first valve space and having first coolant passages formed at a predetermined position from an interior circumference to an exterior circumference thereof, wherein one of the first coolant passages is formed at a position corresponding to the connection passage;

a second rotary valve disposed in the second valve space and having second coolant passages formed at a predetermined position from an interior circumference to an exterior circumference thereof, wherein one of the second coolant passages is formed at a position corresponding to the connection passage;

distribution lines respectively connected to positions corresponding to the first coolant passages and the second coolant passages and configured to distribute the coolant passing through the first rotary valve and the second rotary valve, respectively; and a driver configured to rotate the first rotary valve and the second rotary valve, wherein the first and second coolant passages are connected to the connection passage depending on rotation positions of the first rotary valve and the second rotary valve, wherein the coolant exhausted from a cylinder head is supplied to a center of the first rotary valve, and the coolant exhausted from a cylinder block is supplied to a center of the second rotary valve.

2. The engine system of claim 1, wherein the distribution lines includes:

a first distribution line connected to a heater core configured to heat an inner air;

a second distribution line connected to a radiator configured to discharge heat of the coolant;

a third distribution line connected to an oil cooler configured to heat or cool an oil circulating an engine; and a fourth distribution line connected to an EGR cooler configured to cool exhaust gas recirculating from an exhaust line to an intake line.

3. The engine system of claim 2, further comprising a control portion controlling the driver depending on a temperature of the coolant.

4. The engine system of claim 3, wherein the driver includes:

a motor;

a drive gear rotated by the motor;

a first driven gear externally meshed with the drive gear and configured to be rotated together with the first rotary valve; and a second driven gear externally meshed with the first driven gear and configured to be rotated with the second rotary valve.

5. The engine system of claim 4, wherein a number of teeth of the first driven gear is more than a number of teeth of the second driven gear.

6. The engine system of claim 4, wherein the control portion controls the rotation positions of the first rotary valve and the second rotary valve such that the coolant is not flowed to the first, second, third, and fourth distribution lines and the connection passage in a cooling state that the temperature of the coolant is lower than a first predetermined temperature.

7. The engine system of claim 4, wherein the control portion controls the rotation positions of the first rotary valve and the second rotary valve such that the coolant flows to the first distribution line and the coolant is not flowed to the second, third, and fourth distribution lines and the connection passage in a low temperature state that the temperature of the coolant is higher than a first predetermined temperature and is lower than a second predetermined temperature.

8. The engine system of claim 4, wherein:

the control portion controls the rotation positions of the first rotary valve and the second rotary valve such that the coolant flows to the first, third, and fourth distribution lines and the coolant is not flowed to the second distribution line and the first and second rotary valves open the connection passage in a warm state that the temperature of the coolant is higher than a second predetermined temperature and is lower than a third predetermined temperature.

9. The engine system of claim 4, wherein:

the control portion controls the rotation positions of the first rotary valve and the second rotary valve such that the coolant flows to the first, second, third, and fourth distribution lines and the first and second rotary valves close the connection passage in a hot state that the temperature of the coolant is higher than a third predetermined temperature.

10. An engine system with a coolant control valve, comprising:

a valve housing having a first valve space and a second valve space formed at both sides thereof via a partition and including a connection passage formed in the partition;

a first rotary valve disposed in the first valve space and having first coolant passages formed at a predetermined position from an interior circumference to an exterior circumference thereof, wherein one of the first coolant passages is formed at a position corresponding to the connection passage;

a second rotary valve disposed in the second valve space and having second coolant passages formed at a predetermined position from an interior circumference to an exterior circumference thereof, wherein one of the second coolant passage is formed at a position corresponding to the connection passage;

distribution lines respectively connected to positions corresponding to the first coolant passages and the second coolant passages and configured to distribute the coolant passing through the first rotary valve and the second rotary valve; and a control portion configured to control the first rotary valve and the second rotary valve through a driver and configured to selectively connect the first and second coolant passages to the connection passage, respectively, wherein the control portion controls rotation positions of the first rotary valve and the second rotary valve in a warm state that a temperature of the coolant is higher than a second predetermined temperature and is lower than a third predetermined temperature such that the first and second rotary valves open the connection passage, the coolant is supplied to a heater core through at least one of the first coolant passages of the first rotary valve, and the coolant is supplied to an oil cooler and an EGR cooler through the second coolant passages of the second rotary valve.

11. An engine system with a coolant control valve, comprising:

a valve housing having a first valve space and a second valve space formed at both sides thereof via a partition and including a connection passage formed in the partition;

a first rotary valve disposed in the first valve space and having first coolant passages formed at a predetermined position from an interior circumference to an exterior circumference thereof, wherein one of the first coolant passages is formed at a position corresponding to the connection passage;

a second rotary valve disposed in the second valve space and having second coolant passages formed at a predetermined position from an interior circumference to an exterior circumference thereof, wherein one of the second coolant passage is formed at a position corresponding to the connection passage;

distribution lines respectively connected to positions corresponding to the first coolant passages and the second coolant passages and configured to distribute the coolant passing through the first rotary valve and the second rotary valve; and a control portion configured to control the first rotary valve and the second rotary valve through a driver and configured to selectively connect the first and second coolant passages to the connection passage, respectively, wherein the control portion controls rotation positions of the first rotary valve and the second rotary valve in a hot state that a temperature of the coolant is higher than a third predetermined temperature such that the first and second rotary valves close the connection passage, the coolant is supplied to a heater core and a radiator through the first coolant passages of the first rotary valve, and the coolant is supplied to an oil cooler and an EGR cooler through the second coolant passages of the second rotary valve.

12. An engine system with a coolant control valve, comprising:

a valve housing having a first valve space and a second valve space formed at both sides thereof via a partition and including a connection passage formed in the partition;

a first rotary valve disposed in the first valve space and having first coolant passages formed at a predetermined position from an interior circumference to an exterior circumference thereof, wherein one of the first coolant passages is formed at a position corresponding to the connection passage;

a second rotary valve disposed in the second valve space and having second coolant passages formed at a predetermined position from an interior circumference to an exterior circumference thereof, wherein one of the second coolant passage is formed at a position corresponding to the connection passage;

distribution lines respectively connected to positions corresponding to the first coolant passages and the second coolant passages and configured to distribute the coolant passing through the first rotary valve and the second rotary valve; and a control portion configured to control the first rotary valve and the second rotary valve through a driver and configured to selectively connect the first and second coolant passages to the connection passage, respectively, wherein the first coolant passages and the second coolant passages do not correspond to the connection passage in the valve housing.

* * * * *